US007684719B2

(12) United States Patent
Kitajima

(10) Patent No.: US 7,684,719 B2
(45) Date of Patent: Mar. 23, 2010

(54) CHARGING APPARATUS AND IMAGE FORMING APPARATUS

(75) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/565,138

(22) Filed: Nov. 30, 2006

(65) Prior Publication Data

US 2007/0127939 A1 Jun. 7, 2007

(30) Foreign Application Priority Data

Dec. 2, 2005 (JP) ..... 2005-349846

(51) Int. Cl.
*G03G 15/02* (2006.01)

(52) U.S. Cl. ..... 399/50; 399/168; 399/174

(58) Field of Classification Search ..... 399/50, 399/168, 174
See application file for complete search history.

(56) References Cited

U.S. PATENT DOCUMENTS 5,164,779 A * 11/1992 Araya et al. ..... 399/176
5,485,248 A * 1/1996 Yano et al. ..... 399/73
5,508,788 A * 4/1996 Watanabe et al. ..... 399/175
5,717,979 A * 2/1998 Senba et al. ..... 399/50
5,907,155 A * 5/1999 Skinner ..... 250/326
6,406,656 B1 * 6/2002 Thompson et al. ..... 264/328.1
6,532,347 B2 3/2003 Watanabe et al. ..... 399/50
6,591,072 B2 7/2003 Hashimoto et al.
6,807,389 B2 * 10/2004 Facci et al. ..... 399/89
2004/0013438 A1 * 1/2004 Watanabe et al. ..... 399/50
2004/0218939 A1 * 11/2004 Motohashi et al. ..... 399/50

FOREIGN PATENT DOCUMENTS

JP 2001-201921 7/2001

* cited by examiner

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

An image forming apparatus includes an image bearing member; a charging member for electrically charging the image bearing member through electric discharge by applying, to the charging member, a DC voltage biased with an AC voltage; and voltage condition determination means for determining a voltage condition during image formation on the basis of each of the values of AC currents obtained by applying a plurality of DC voltages biased with the AC voltages to said charging member.

2 Claims, 16 Drawing Sheets

CHARGING APPARATUS AND IMAGE FORMING APPARATUS

FIELD OF THE INVENTION AND RELATED ART

The present invention relates to a charging apparatus and image forming apparatus for electrically charging a surface of an image bearing member by applying a bias consisting of a DC voltage biased with an AC voltage to a charging member disposed in contact with or close to the surface of the image bearing member.

Conventionally, for example, as a method of electrically charging a surface of an image bearing member as a member to be electrically charged such as a photosensitive member or a dielectric member, a contact charging method has become mainstream in place of a non-contact charging method such as a corona discharging.

In this contact charging method, the image bearing member surface is electrically charged by applying a voltage to a charging member disposed in contact with or close to the image bearing member. The charging member includes a charging roller in a roller shape or a charging blade in a blade shape. Particularly, the charging roller has such an advantage that it is capable of stably charging the image bearing member for a long period of time.

As the voltage to be applied to the charging member, it is possible to use only a DC voltage but in the case where an oscillation or vibration voltage consisting of a DC voltage biased with an AC voltage is applied so as to cause alternately repeated electric discharge between the charging member and the image bearing member, it is possible to uniformly charge the image bearing member surface.

For example, an oscillation voltage consisting of a DC voltage (DC offset bias) biased or superposed with a peak-to-peak voltage which is two times or more a discharge start threshold voltage (charge start voltage) Vth of an image bearing member at the time of applying a DC voltage, is applied. The application of this oscillation voltage is effective in uniformizing a charge potential at the surface of the image bearing member. As a waveform of the oscillation voltage, it is not limited to a sine (sinusoidal) wave but may also be a rectangular wave, a triangular wave, and a pulse wave. Further, the oscillation voltage may also include a rectangular voltage formed by periodically turning a DC voltage on and off and such a voltage that it has the same output as that of a superposed voltage of an AC voltage with a DC voltage by periodically changing a value of a DC voltage.

In the following description, a contact charging method for electrically charging the charging member by applying the oscillation voltage to the charging member is referred to as an "AC charging method" and a contact charging method for electrically charging the charging member by applying only a DC voltage to the charging member is referred to as a "DC charging method".

Compared with the DC charging method, the AC charging method is accompanied with not only a problem that an amount of electric discharge to the image bearing member is increased, thus accelerating a deterioration of the image bearing member such as wearing or abrasion of the image bearing member but also a problem that an abnormal image such as an image flow due to discharge products in a high temperature/high humidity (H/H) environment is caused to occur in some cases.

In order to solve these problems, minimization of an amount of electric discharge alternately generated between the charging member and the image bearing member by applying a minimum voltage is effective.

However, an actual relationship between the applied voltage and the discharge amount is not always constant but is changed depending on thicknesses of a photosensitive layer and dielectric layer of the image bearing member and environmental changes of the charging member and ambient air.

For example, in a low temperature/low humidity environment of 15° C./10%, electric resistances of the image bearing member and the charging member are increased, thus causing less electric discharge. For this reason, in order to ensure uniform charging, a peak-to-peak voltage of a certain value or more is required. Further, even at a minimum voltage value capable of providing charging uniformity in such a low temperature/low humidity (L/L) environment, excessive discharge is caused in the case where a charging operation is performed in a high temperature/high humidity (H/H) environment of 30° C./80%. As a result, when the discharge amount is increased, there arise problems such as occurrences of image flow, image blur, toner melt-sticking and wearing and short life of the image bearing member due to a surface deterioration of the image bearing member.

In order to suppress an increase and decrease in charge amount due to the environmental change, in addition to an AC constant voltage control method in which a certain AC voltage is always applied as described above, an AC constant current control method in which a value of AC passing through the charging member is controlled by applying an AC voltage to the charging member has also been proposed.

According to the AC constant current control method, it is possible to decrease a peak value of the AC voltage in the L/L environment in which an electric resistance of a material is increased and also to decrease a value of the peak-to-peak voltage in the H/H environment. As a result, compared with the AC constant voltage control method, it is possible to effectively suppress the increase and decrease in discharge amount.

Here, the charging member is not necessarily required to contact the image bearing member surface but may also be disposed in proximity to the image bearing member surface in a noncontact state with a gap therebetween of, e.g., 10 μm so long as a discharge enable area determined by a voltage in the gap and modified Paschen curve is ensured with reliability. In the following description, the contact charging also includes the case of such proximity charging as described above.

When a long life of the above-described image bearing member is intended to be realized, even in the AC constant current control method, it is difficult to sufficiently suppress the increase and decrease in discharge amount due to a fluctuation in resistance value resulting from variation of production and contamination of the charging member, a fluctuation in electrostatic capacitance of the image bearing member during successive use, and a variation of a high voltage apparatus of a main assembly of image forming apparatus.

In order to suppress the increase and decrease in amount of discharge current, suppressions of dimension and resistance value of the charging member during production, an environmental change, and a change in high voltage of a power source are effective but for that purpose, production costs are increased.

As countermeasures against these problems, Japanese Laid-Open Patent Application (JP-A) 2001-201921 has proposed the following charge control method.

(1) In this charge control method, a charging means for electrically charging an image bearing member is disposed in contact with or in proximity to the image bearing member and electrically charges the image bearing member surface by applying thereto a voltage. The method employs a means for applying either one or both (superposition) of a DC voltage and an AC voltage, a means for controlling each of the values of the DC voltage and a peak-to-peak voltage of the AC voltage applied to the charging means, and a means for measuring a value of AC current passing through the charging means via the image bearing member. When a discharge start voltage to the image bearing member during application of a DC voltage to the charging member is taken as Vth, at least one peak-to-peak voltage of a value less than two times the value Vth is applied to the charging means. A current value at this time and current values at the time of applying at least two peak-to-peak voltages of values two times or more the value Vth are measured. This charging control method is characterized in that a peak-to-peak voltage of an AC voltage to be applied to the charging means during image formation is determined from measured AC current values.

(2) A value of peak-to-peak voltage satisfying the following relationship is determined:

$$fI2(Vpp)-fI1(Vpp)=\Delta Is,$$

wherein ΔIs represents a preliminarily determined constant, fI1(Vpp) represents a peak-to-peak voltage-AC function obtained by connecting 0 to a current value at the time of applying one peak-to-peak voltage less than two times the value Vth to the charging means, and fI2(Vpp) represents a peak-to-peak voltage-AC function obtained from current values at the time of applying at least two peak-to-peak voltages two times or more the value Vth to the charging means. At the thus determined value of peak-to-peak voltage, a peak-to-peak voltage of an AC voltage to be applied to the charging means during image formation is constant voltage-controlled, the above described charge control method is referred hereinafter to as "discharge current control".

The above-described discharge current control described in JP-A 2001-201921 has such a constitution that an AC voltage is applied in a state of a DC voltage of zero volts during the discharge current control.

In this case, however, there arises such a problem that a surface potential obtained by applying a predetermined DC voltage biased with an AC voltage during image formation under a charging condition determined by the discharge current control in the state of a discharge current voltage of zero volts is slightly different from a target surface potential.

This may be attributable to the following phenomenon. The above-described countermeasure described in JP-A 2001-201291 is based on the precondition that it is achieved only in the case where a slope α of a line associated with values of [surface potential−(DC voltage+(½)Vppth)] in a DC discharge characteristic is 1 as shown in FIG. 6.

However, the slope α when a DC voltage biased with an AC voltage is applied is approximately 1 as shown in FIG. 7. Further, it was confirmed that the slope α is not completely 1 even in the case where a charging roller and an image bearing member were used in a brand new condition, as shown in FIG. 8.

In other words, there is a difference between the slope α obtained by applying the predetermined DC voltage biased with the AC voltage and the slope α obtained by applying the AC voltage with the DC voltage of zero volts. For this reason, when image formation is performed under the conventional condition that the charge condition is determined in the state of the DC voltage of zero volts, the above-described difference is not eliminated, thus resulting in an occurrence of a problem such that a necessary target potential cannot be obtained.

SUMMARY OF THE INVENTION

A principal object of the present invention is to provide a charging apparatus and image forming apparatus capable of providing a target potential at a value of charge DC voltage during image formation.

According to an aspect of the present invention, there is provided an image forming apparatus, comprising:

an image bearing member;

a charging member for electrically charging the image bearing member through electric discharge by applying, to the charging member, a DC voltage biased with an AC voltage; and voltage condition determination means for determining a voltage condition during image formation on the basis of a value of an AC current obtained by applying, to the charging member, the DC voltage biased with the AC voltage.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
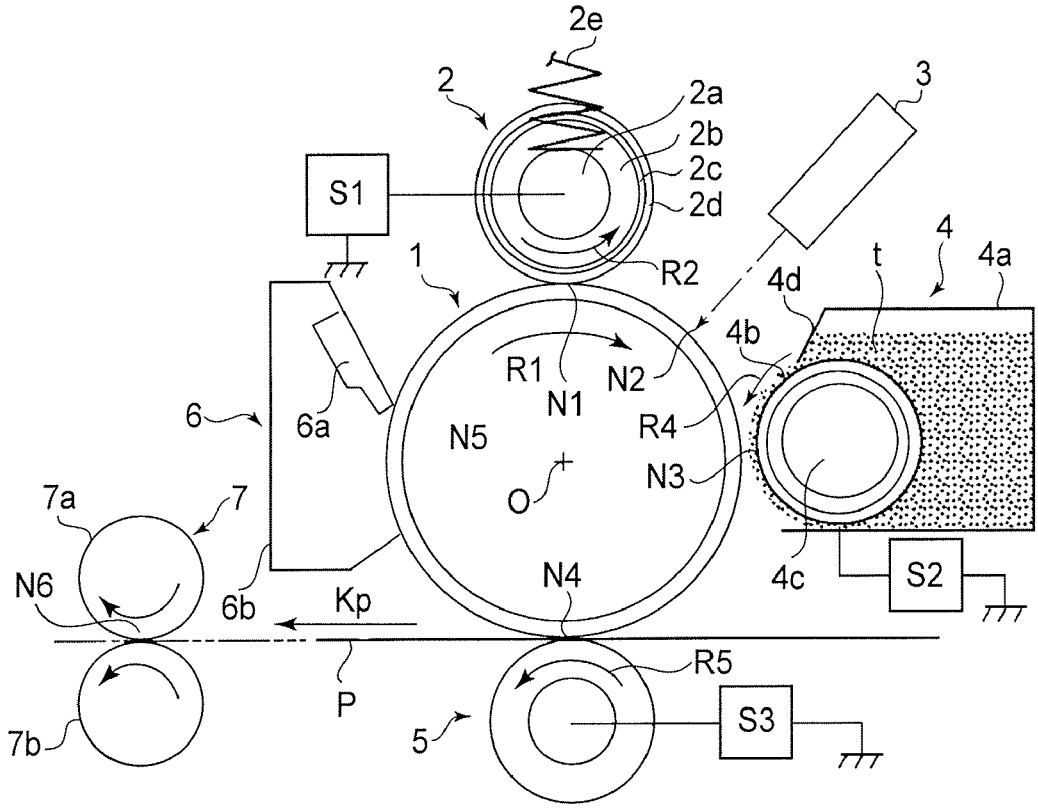
FIG. 1 is a schematic view for illustrating a general structure of an image forming apparatus to which the present invention is applicable.

Hereinbelow, embodiments of the present invention will be described with reference to the drawings. In the following description, members or means indicated by identical reference numerals in the drawings have the same constitutions or functions, thus being appropriately omitted to avoid redundant explanations.

Embodiment 1

FIG. 1 shows an image forming apparatus to which the present invention is applicable. The image forming apparatus shown in FIG. 1 is a laser beam printer utilizing an electrophotographic method, a contact charging method, and a reversal developing method. FIG. 1 is a schematic view showing a longitudinal cross section of the printer viewed from a front side on which a user or service person is located during an operation of the printer. A maximum size of recording material capable of being subjected to image formation or printing by the printer is A3 size.

(1) General Constitution of Printer

A constitution and operation of the printer will be schematically described with reference to FIG. 1.

Referring to FIG. 1, the printer includes a photosensitive drum 1. Around the photosensitive drum, along a rotation direction (of an indicated arrow R1) thereof members including a charging roller 2 as a contact charging member (charging means), an exposure apparatus 3 as an information writing means, a developing apparatus 4 as a developing means, a transfer roller 5 as a transfer means, and a cleaning apparatus 6 as a cleaning means are disposed substantially in this order. Further, a fixing device 7 as a fixing means is disposed on a downstream side from the transfer roller 5 along a conveyance direction (of an indicated arrow Kp) of a recording material P, as a recording medium used for printing, such as paper or a transparent film. Hereinafter, the photosensitive drum 1 to the fixing device 7 will be specifically described in this order.

Figure 2:
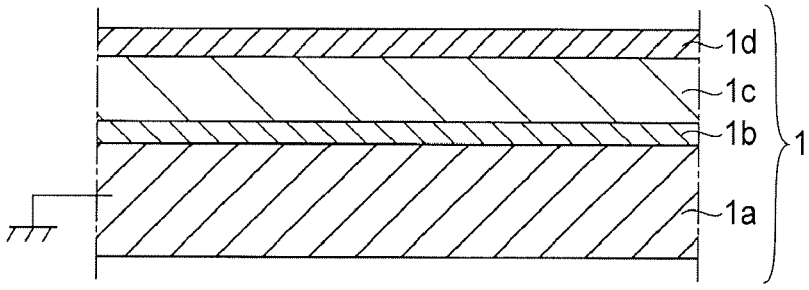
FIG. 2 is a longitudinal cross-sectional view for illustrating a layer structure of a photosensitive layer.

In this embodiment, as the photosensitive drum 1, a rotation drum-type photosensitive member such as a negatively chargeable OPC (organic photoconductor) is used. FIG. 2 shows a layer structure of the photosensitive drum 1. FIG. 2 is a schematic view showing a part of a longitudinal cross section when the photosensitive drum is cut in a plane including its center axis O (FIG. 1). In FIG. 2, a lower portion corresponds to an inner side of the photosensitive drum 1, and an upper portion corresponds to an outer side of the photosensitive drum 1. The photosensitive drum 1 is constituted by four layers. More specifically, as shown in FIG. 2, on a surface of an aluminum cylinder (electroconductive drum support) 1*a* disposed at an innermost portion, three layers including an undercoat layer 1*b* for suppressing light interference and improving an adhesiveness to an overlying layer, a photocharge generation layer 1*c*, and a charge transport layer 1*d* are successively coated. The entire photosensitive drum 1 is formed in an outer diameter of 30 mm and is rotationally driven around the center axis O by drive means (not shown) at a process speed (peripheral speed) of 210 mm/sec in the direction of the indicated arrow R1 (FIG. 1). The aluminum cylinder 1*a* is grounded.

In this embodiment, as the charging means, the charging roller 2 as the contact charging member is used. The charging roller 2 is, as shown in FIG. 1, rotatably supported by an unshown pair of bearing members, at both end portions of its core metal 2*a*, and is urged toward the photosensitive drum 1 by pressing springs 2*e*, so that the charging roller 2 is pressed against the surface of the photosensitive drum 1 at a predetermined pressing force. For this reason, the charging roller 2 is rotated in a direction of an arrow R2 by the rotation of the photoconductive drum 1. A (press-)contact portion where the photoconductive drum 1 and charging roller 2 contact each other and the neighborhood thereof constitute a charging portion (charging portion) N1. To the core metal 2*a* of the charging roller 2, a charge bias voltage, which satisfies predetermined requirements, is applied from an electrical power source (charging bias application power source) S1. As a result, the surface of the photosensitive drum 1 is electrically uniformly charged to a predetermined polarity (negative in this embodiment). A constitution and charge control of the charging roller 2 will be described later.

The exposure apparatus 3 is an information writing means for forming an electrostatic latent image on the electrically charged surface of the photosensitive drum 1.

The exposure apparatus 3 in this embodiment is a laser beam scanner employing a semiconductor laser. The exposure apparatus 3 output laser light which is modulated in correspondence with image formation sent to the printer from an unshown host such as an image reading apparatus. With the laser light, the surface of the photosensitive drum 1 after charging is subjected to (imagewise) scanning exposure at an exposure portion (exposure position). As a result, on the surface of the photosensitive drum 1, electric charges at the exposure portion are removed, so that an electrostatic latent image corresponding to image information is formed.

The developing apparatus 4 develops the electrostatic latent image formed on the above-described photosensitive drum 1 with toner. The developing apparatus 4 includes a developer container 4*a*, a nonmagnetic developing sleeve 4*b*, a magnet roller 4*c*, and a regulation blade 4*d*. In the developer container 4*a*, as developer, negatively chargeable monocomponent magnetic toner t is accommodated. At a portion of the developer container 4*a* opposite to the photosensitive drum 1, an opening is provided. At the opening, the developing sleeve 4*b* is rotatably disposed in an arrow R4 direction to the developing sleeve 4*b*, a developing bias is applied from a power source (developing bias application power source) S2. The magnet roller 4*c* is fixedly disposed inside the developing sleeve 4*b*. The toner t in the developer container 4*a* is carried on the surface of the developing sleeve 4*b* by magnetism of the magnet roller 4*c* and after being regulated in layer thickness by the regulation blade 4*d*, is conveyed to a developing portion (developing position) N3 by the rotation of the developing sleeve 4*b* in the arrow R4 direction. At this time, the developing bias is applied from the power source S2 to the developing sleeve 4*b*, whereby the toner t on the developing sleeve 4*b* is selectively deposited on the electrostatic latent image on the surface of the photosensitive drum 1 to develop the electrostatic latent image. In this embodiment, such a reverse developing method that the development is effected by depositing the toner t on the surface of the photosensitive drum 1 at a light-exposed portion is employed. Incidentally, the toner t which has not been subjected to the development passes through the developing portion N3 to be returned to the inside of the developer container 4*a*.

The transfer roller 5 is pressed against the photosensitive drum 1 surface from below the photosensitive drum 1 to form a transfer portion (transfer position) N4 therebetween. The transfer roller 5 is rotated in a direction of an indicated arrow R5 by the rotation of the photosensitive drum 1. To the transfer roller 5, a transfer bias is applied from a power source (transfer bias application power source) S3. The transfer material P subjected to transfer is fed in a direction of an indicated arrow Kp to be conveyed to the transfer portion N4 by a feeding/conveying means (not shown). At the time when the recording material passes through the transfer portion N4, a positive transfer bias is applied from the power source 3 to the transfer roller 5, whereby the toner image on the photosensitive drum 1 is electrostatically transferred onto the recording material P.

The cleaning apparatus 6 includes a cleaning blade 6*a* pressed against the photosensitive drum 1 surface to form a cleaning portion N5 and a cleaning container 6*b*. Toner (transfer residual toner) remaining on the photosensitive drum 1 surface without being transferred onto the recording material P during the toner image transfer is wiped with the cleaning blade 6*a* to be recovered into the cleaning container 6*b*. The thus surface-cleaned photosensitive drum 1 is subjected to a next image formation cycle.

The fixing device 7 includes a fixing roller 7*a* containing therein a heater and a pressing roller 7*b* pressed against the fixing roller 7*a* from below the fixing roller 7*a*. Between the fixing roller 7*a* and the pressing roller 7*b*, a fixing portion N6 is created. The recording material P on which the toner image is transferred at its surface by the above-described transfer is passed through the fixing portion N6 under heat pressing. As a result, the toner image is fixed on the surface of the recording material P.

Through the above-described respective processes including charging light exposure, development, transfer, cleaning, and fixation, a printing operation for one sheet of the recording material P is completed.

(2) Operation Sequence of Printer

Figure 3:
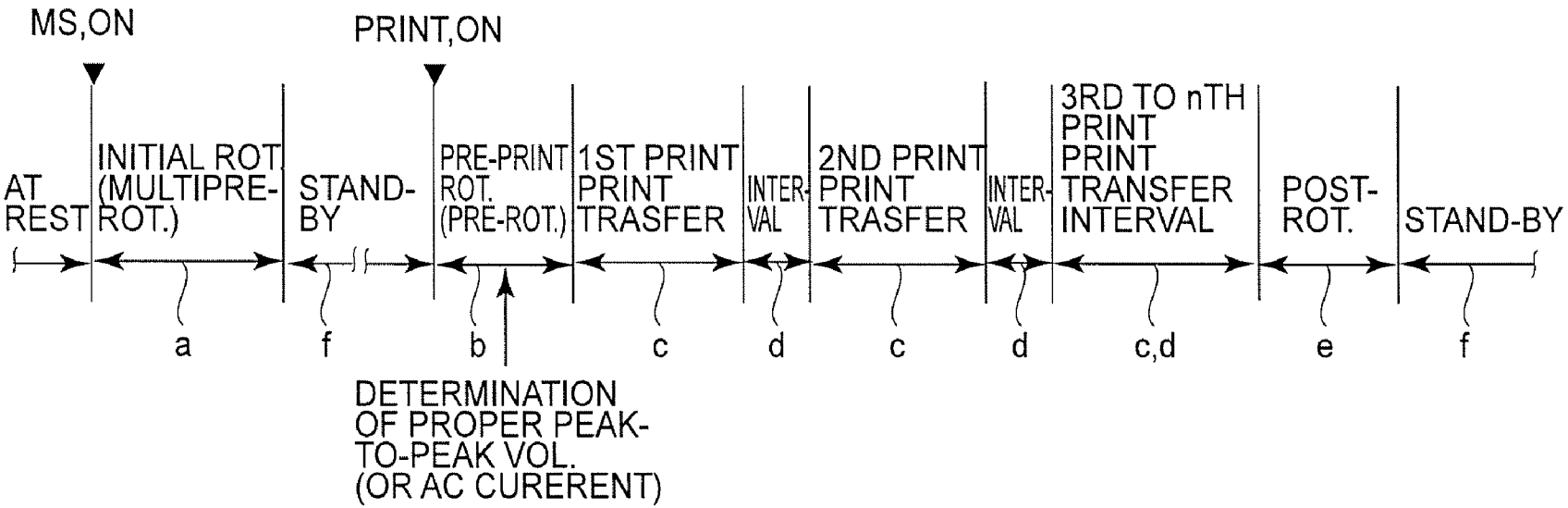
FIG. 3 is a schematic view for illustration of an operation sequence of the image forming apparatus.

With reference to FIG. 3, an operation sequence of the above-described printer will be described.

(a) Initial Rotation Operation (Multiple Pre-rotation Step)

An initial rotation operation is an operation in an actuating operation period (startup operation period or warm-up period) during startup of the printer. By turn-on of a power switch, the photosensitive drum 1 is rotationally driven. Further, a preparatory operation of a predetermined process equipment such that the fixing device 7 rises in temperature up to a predetermined temperature, is performed.

(b) Pre-print Rotation Operation (Pre-rotation Step)

A pre-print rotation operation is a pre-rotation operation before image formation in a period from ON-state of print signal to start of an actual image forming (printing) step operation. During the initial rotation operation, when the print signal is inputted, the pre-print rotation operation is performed in succession to the initial rotation operation. When the print signal is not inputted, a drive of a main motor is once stopped after completion of the initial rotation operation, so that the photosensitive drum 1 stops its rotation. The printer is kept in stand-by f state until the print signal is inputted. When the print signal is inputted, the pre-print rotation operation is performed.

In this embodiment, in this pre-print rotation operation period, operation/determination program for an appropriate peak-to-peak voltage value (or an AC current value) of an applied AC voltage in a charging step of a printing step is executed. This will be described more specifically later.

(c) Printing Step and Transfer Step (Image Forming Step)

When the predetermined pre-print rotation operation is completed, an image forming process is performed with respect to the rotating photosensitive drum 1. The toner image formed on the photosensitive drum 1 surface is transferred onto the recording material P, and then is fixed on the recording material P by the fixing device 7. The recording material P after the toner image fixation is then outputted or printed out. In the case of a continuous print mode, this printing step (transfer step) is repetitively performed for a predetermined number n of set print sheets.

(d) Interval Step

An interval step is performed in a period, of non-sheet-passing state of the recording material P at the transfer portion N4, from passing of a trailing edge of one sheet of recording material P at the transfer portion N4 to reaching of a leading edge of a subsequent sheet of recording material P.

(e) Post-rotation Operation

After the printing step of the final recording material is completed, the main motor is still rotated for a predetermined time. As a result, the photosensitive drum 1 continues its rotation for the predetermined time. The post-rotation operation is performed for the predetermined time (period).

(f) Standby

When the predetermined post-rotation operation is completed, the main motor is stopped and the rotation of the photosensitive drum 1 is also stopped. The printer is kept in a standby state until a subsequent print start signal is inputted. In the case of printing only one sheet of recording material P, the printer is placed in the standby state through the post-rotation operation after the printing. When the print start signal is inputted in the standby state of the printer, the operation goes to the above-described pre-rotation step.

The printing step (c) is performed during image formation. Further, the initial rotation operation (a), the pre-rotation operation (b), the interval step (d), and the post-rotation step (e) are performed during non-image formation.

The charging roller 2 as the contact charging member has a length of 320 mm in a longitudinal (lengthwise) direction along the center axis O of the photosensitive drum 1. The charging roller 2 comprises, as shown in FIG. 2, the aforementioned core metal 2*a* (supporting member), and three layers including an undercoat layer 2*b*, an intermediary layer 2*c*, and a surface layer 2*d*, which are placed in layers on the peripheral surface of the core metal 2*a*, in this order. The undercoat layer 2*b* is a foamed sponge layer for reducing the charging noises. The intermediary layer 2*c* is an electroconductive layer for obtaining a uniform electric resistance as the entire charging roller. The surface layer 2*d* is a protective layer provided for preventing an occurrence of electrical leakage even when the peripheral surface of the photoconductive drum 1 has defects such as pin holes.

More specifically, the specification of the charging roller 2 used in this embodiment is as follows:

core metal 2*a*: a stainless steel rod with a diameter of 6 mm;

undercoat layer 2*b*: formed of foamed ethylene-propylene-diene terpolymer (EPDM) in which carbon black has been dispersed; 0.5 g/cm$^3$ in specific gravity; $10^3$ ohm.cm in volume resistivity; and 3.0 mm in thickness and 320 mm in length;

intermediary layer 2*c*: formed of acrylonitrile-butadiene rubber (NBR) in which carbon black has been dispersed; $10^5$ ohm.cm in volume resistivity; and 700 μm in thickness; and surface layer 2*d*: formed of Toresin resin (a fluorinated compound), in which tin oxide and carbon black have been dispersed; $10^8$ ohm.cm in volume resistivity; 1.5 μm in surface roughness (10 point average surface roughness Ra in JIS); and 10 μm in thickness.

(B) Charging Bias Application System

Figure 4:
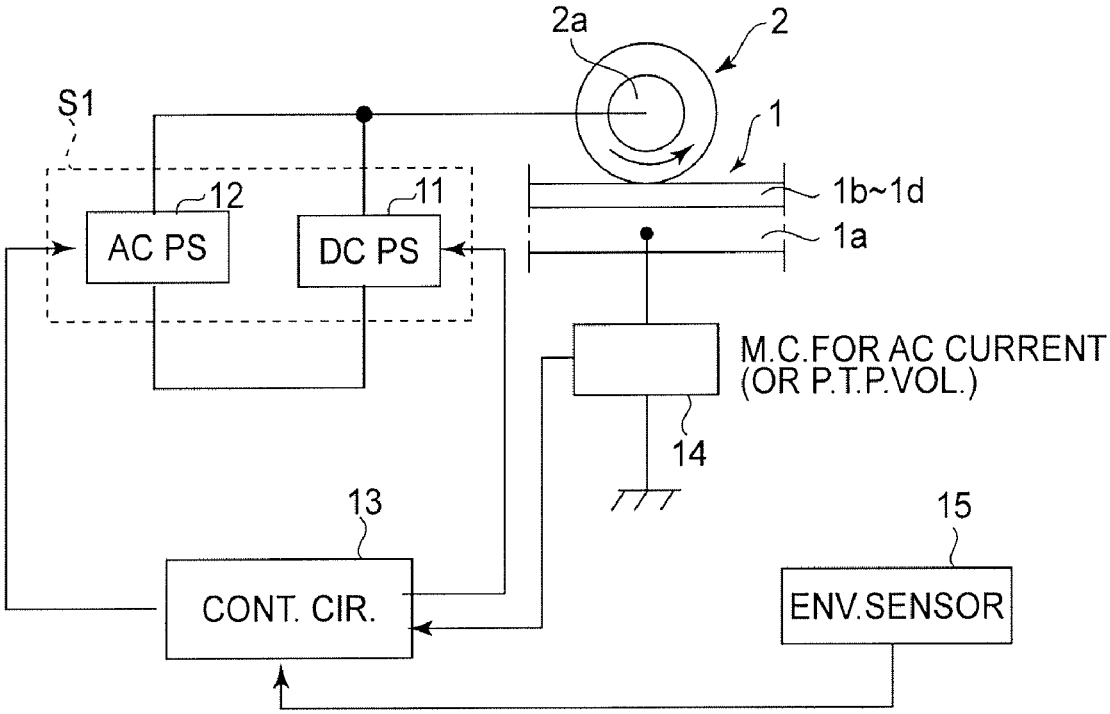
FIG. 4 is a block circuit diagram of a charging bias application system.

FIG. 4 is a block circuit diagram of a charging bias application system with respect to the charging roller 2.

The outer peripheral surface of the rotating photosensitive drum 1 is charge-processed to a predetermined polarity and potential by applying a predetermined oscillating voltage, consisting of a DC voltage superposed with an AC voltage having a frequency f (charging bias voltage Vdc+Vac), from the power source S1 to the charge roller 2 via the core metal 2*a*.

The power source S1 as voltage application means for the charging roller 2 includes a DC power source 11 and an AC power source 12 which are controlled by a control circuit (control means) 13. The control circuit 13 has a function of controlling the power source S1 so that either one or both of the DC voltage and the AC voltage are applied to the charging roller 2 by turning the DC power source 11 and/or the AC power source 12 on or off. The control circuit 13 also has a function of controlling the DC voltage value applied from the DC power source 11 to the charging roller 2 and the peak-to-peak voltage value of the AC voltage applied from the AC power source 12 to the charge roller 2. To the control circuit 13, an AC current value measurement circuit 14 as a means for measuring a value of AC current (or peak-to-peak voltage) is connected. The measured value by the AC current value measurement circuit 14 is inputted into the control circuit 13 as AC current value information.

Further, to the control circuit, an environmental sensor 15 for detecting an environment, of a place where the printer is mounted, such as a temperature or a humidity is connected. Environmental information detected by the environmental sensor 15 is inputted into the above-described control circuit 13.

On the basis of the AC current value measurement circuit 14 and the environmental information inputted from the environmental sensor 15, the control circuit has a function of executing a processing/determination program for an appropriate peak-to-peak voltage value of the AC voltage applied to the charging roller 2 in the charging step in the printer step.

(C) Control Method of Peak-to-peak Voltage of AC Voltage

Next, a control method of the peak-to-peak voltage of the AC voltage applied to the charging roller 2 during the printing will be described.

An amount of discharge current converted into numerical value according to a definition described below (formula 1) is used as a substitution for an actual amount of AC discharge, as also described in JP-A 2001-201921, and correlated with abrasion of the photosensitive drum 1, image flow, and charge uniformity.

Figure 5:
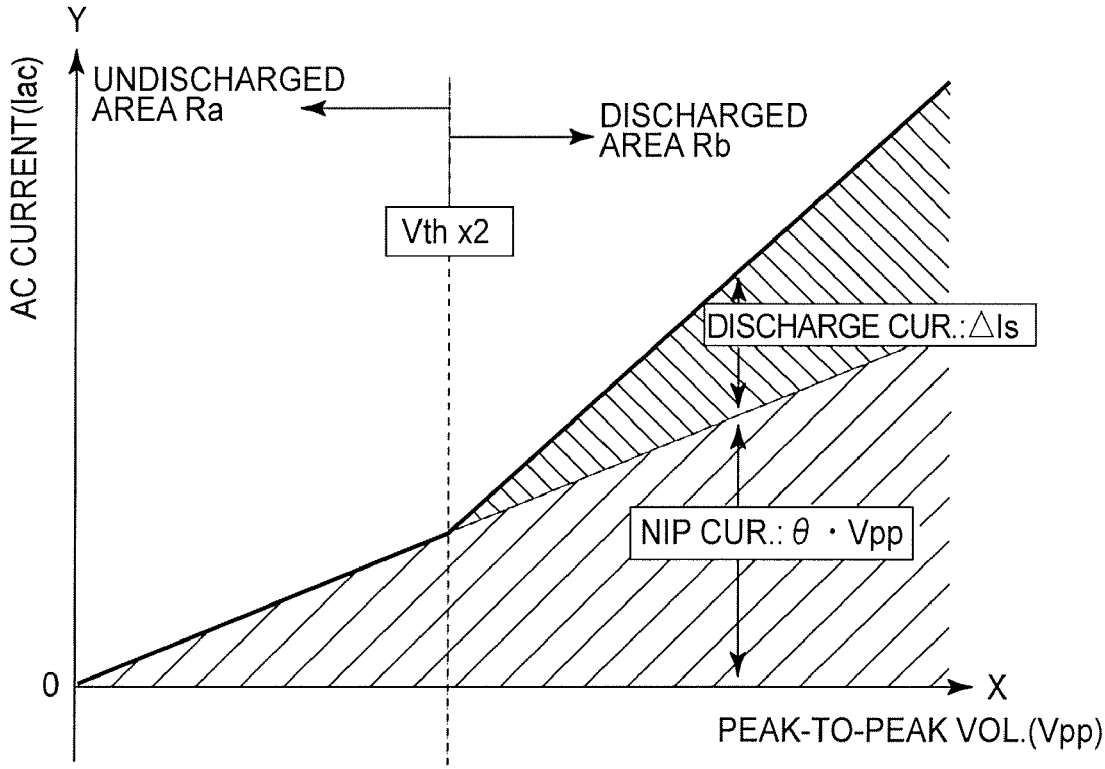
FIG. 5 is a graph for illustrating schematically a measurement of an amount of discharge current.

More specifically, as shown in FIG. 5, an AC current Iac shown in Y-axis (ordinate) has a relationship with a peak-to-peak voltage Vpp shown in X-axis (abscissa). The AC current Iac has a linear relation to a peak-to-peak voltage Vpp, such that the line passes through the origin, in an area less than a value of a discharge start voltage Vth×2 (V), i.e., in an undischarged area Ra, and the line is then linearly increased gradually in a discharged area Rb, in which the peak-to-peak voltage Vpp exceeds the value (Vth×2 (V)), with an increasing peak-to-peak voltage value. In a similar experiment in a vacuum where electric discharge is not caused, the linearity of Iac passing through the origin is kept also in the discharged area Rb, so that the resultant deviation of Iac may be considered to represent an increment of current ΔIac contributing to the electric discharge.

When a ratio of the AC current Iac to the peak-to-peak voltage Vpp less than the value of (discharge start voltage Vth)×2 (V), i.e., Iac/Vpp, is taken as θ, an AC current, other than the current due to discharge, such as a current flowing through the contact portion between the photosensitive drum 1 and the charging roller 2 (hereinafter referred to a "nip current") is represented by θ.Vpp. A difference between the current value Iac measured during the application of a voltage equal to or more than the value of (discharge start voltage Vth)×2 (V) and the value θ.Vpp is represented by the following formula 1:

$$\Delta Is = Iac - \theta . Vpp \qquad \text{(formula 1)}$$

The value ΔIs is defined as discharge current amount as a substitution for a discharge amount.

The discharge current amount is changed depending on changes in environmental condition and continuous image formation state in the case where the photosensitive drum 1 is electrically charged under control at a constant voltage or a constant current. This is because a relationship between the peak-to-peak voltage Vpp and the discharge current amount ΔIs and a relationship between the AC current value (current Iac) and the discharge current amount ΔIs are changed.

In an AC constant current control method, the charging of the photosensitive drum 1 is generally controlled by a total amount of current flowing from the charging member (corresponding to the charging roller 2 in this embodiment) to the member to be charged (the photosensitive drum 1 in this embodiment). The total current amount is a sum of the nip current θ.Vpp passing through the above described contact portion between the charging member and the member to be charged and the discharge current amount ΔIs which is carried by the discharge at the non-contact portion. In the constant current control method, the charge control is effected by current including not only the amount ΔIs of discharge current which is current necessary to actually charge electrically the member to be charged but also the nip current θ.Vpp.

For this reason, the discharge current amount ΔIs cannot be actually controlled. In the constant current control method, even in the case of effecting control at the same current value, depending on an environmental change of a material for the charging member, the discharge current amount ΔIs is decreased correspondingly when the nip current θ.Vpp is increased and is increased correspondingly when the nip current θ.Vpp is decreased. For this reason, it is impossible to completely suppress a change (increase/decrease) in discharge current amount even by the AC constant current control method.

Figure 6:
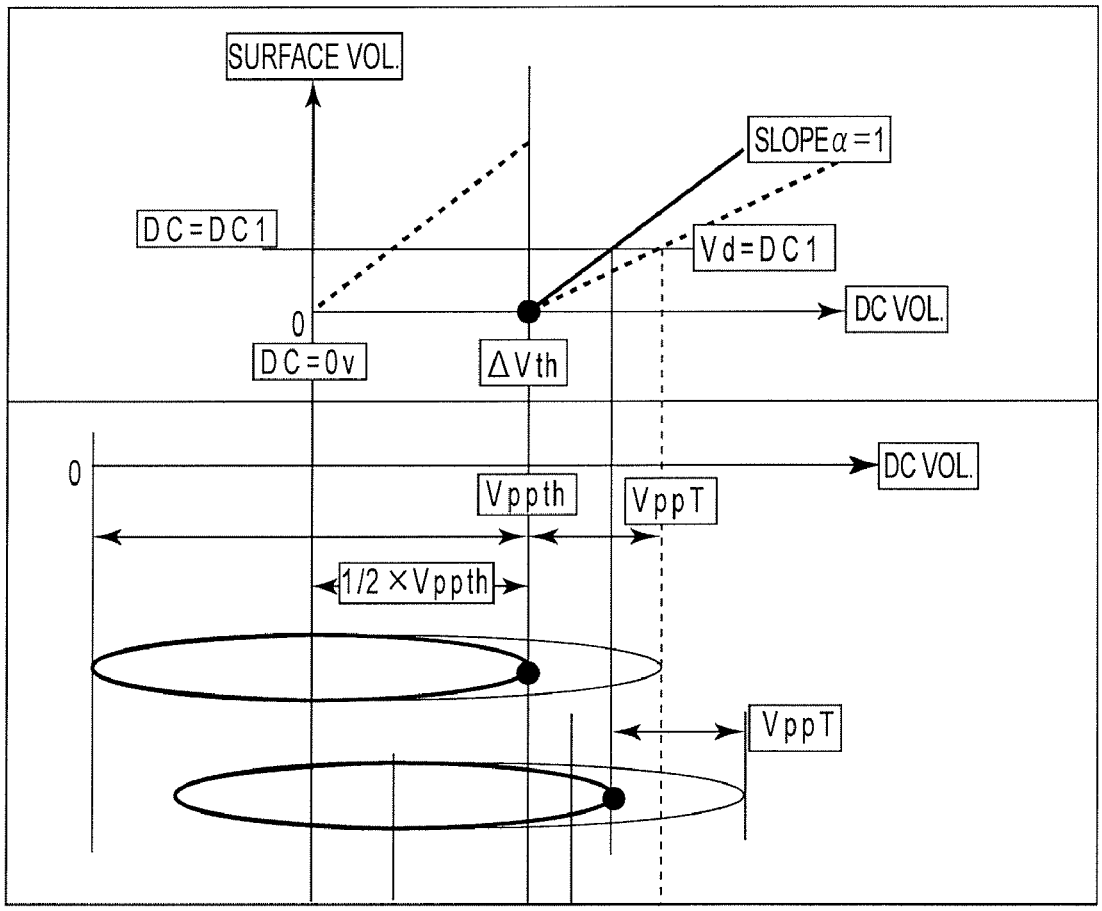
FIGS. 6 and 7 are schematic views for illustrating AC+DC discharge current control when α=1 and α<1, respectively, in DC discharge characteristics.
Figure 7:
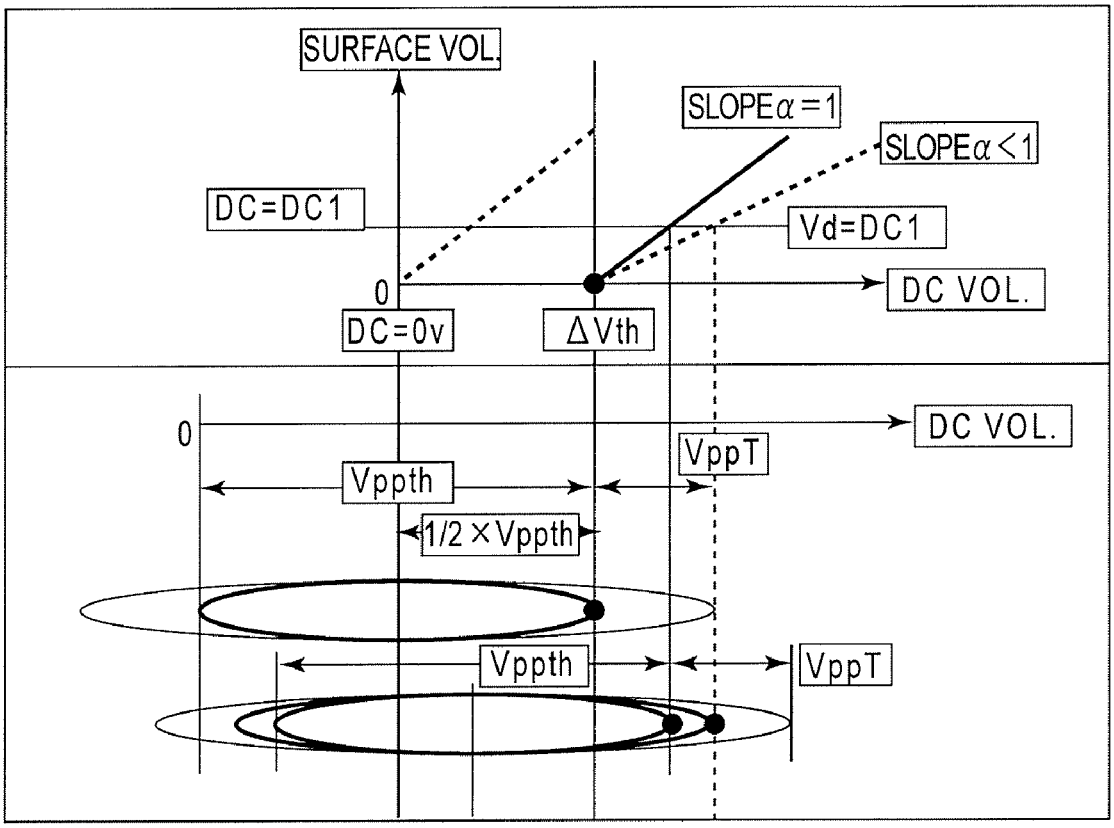

Further, in order to compatibly realize both of suppression of wearing of the photosensitive drum 1 and charge uniformity, JP-A 2001-201921 has disclosed a method in which a constant discharge current control can be always effected. However, the method disclosed in JP-A 2001-201921 is based on a precondition that a slope α of a DC discharge characteristic satisfies α=1, i.e., is always constant as shown in FIG. 6. The DC discharge characteristic is, as shown in FIG. 6, a relationship between a DC voltage (V) (abscissa) to be applied and a surface potential (V) (ordinate) of a member to be charged. However, according to a study of the present inventor, there is also the case of α<1 as shown in FIG. 7.

Here, a problem occurring in the case where the slope α of the DC discharge characteristic satisfies α<1 will be described.

In the case of α=1, as shown in FIG. 6, when the charge DC voltage is zero volts, a DC discharge start voltage Vth is (½) Vppth, so that even when the charge DC voltage is switched to that for an image forming condition, it is possible to obtain a target discharge current amount ΔIs determined during the execution of the discharge current control.

However, as shown in FIG. 1, in addition to the case of α=1, the case of α<1 is actually present. In the case of α<1, when a peak-to-peak voltage determined by the charge DC voltage of zero volts is superposed on a charge DC voltage of DC1 during image formation, a value of Vppth at which the surface potential converges to the charge DC voltage is changed depending on a value of the applied charge DC voltage as shown in the Iac−Vpp characteristic of FIG. 7.

Figure 8:
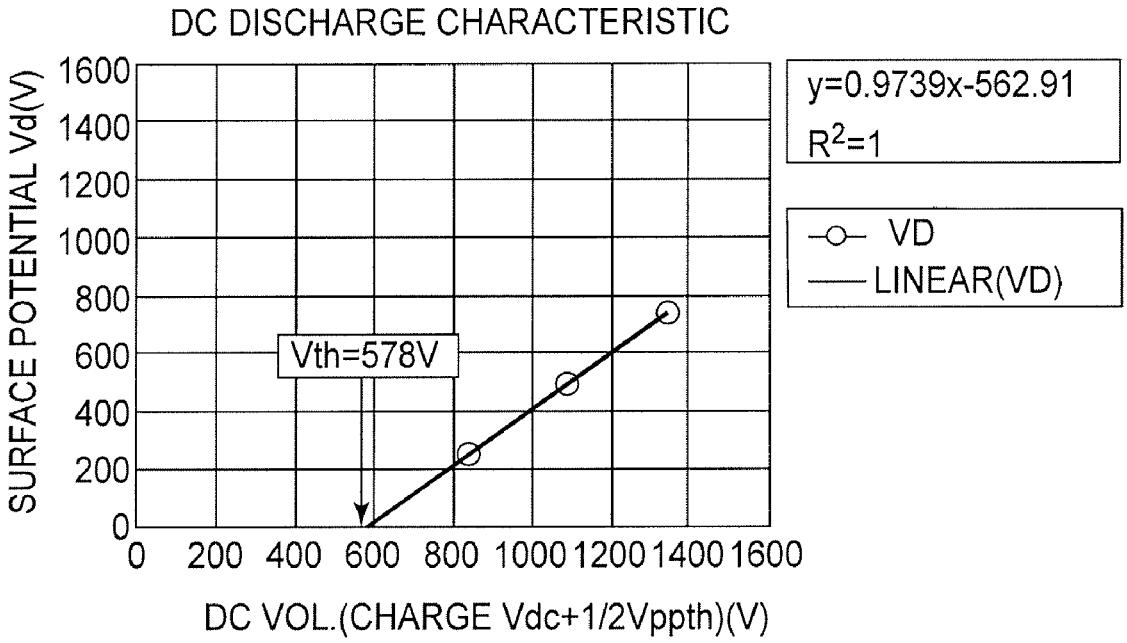
FIG. 8 is a graph showing a relationship between a DC voltage and a surface potential in the case of α<1 in a DC discharge characteristic.

When an AC discharge start peak-to-peak voltage is measured while changing a DC voltage actually applied to the charging member, it has been confirmed that there is the condition of α<1 as shown in FIG. 8.

As described above, under the condition of α<1, when the charge DC voltage at the time of performing the discharge current control is charged, an error occurs in the target discharge current amount ΔIs, so that it has been understood that the discharge current amount ΔIs is not controlled. On the other hand, it has also been confirmed that there is a condition of $\alpha>1$ in the high temperature/high humidity (H/H) condition. In this regard, an explanation will be omitted but the present invention is also applicable to such a case.

Figure 9:
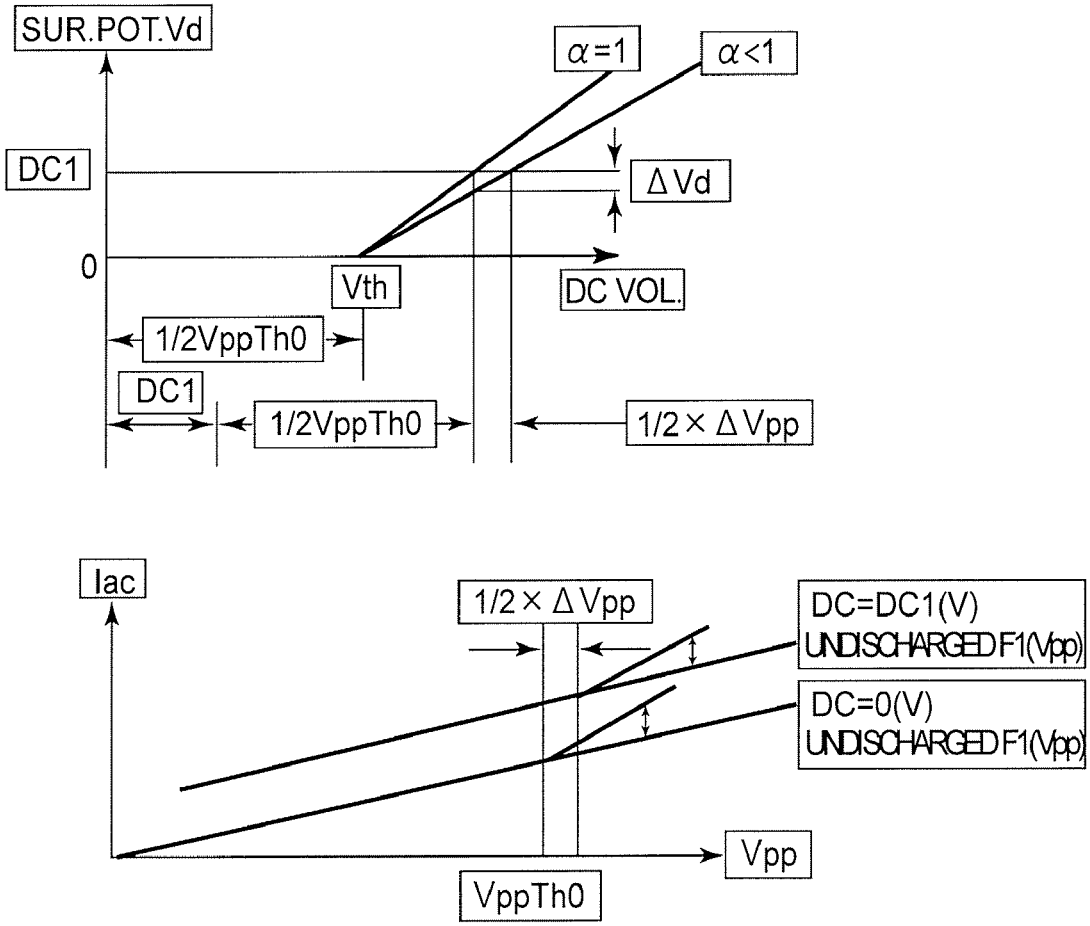
FIG. 9 is a schematic view for illustrating changes in peak-to-peak voltage and ΔVd in the case of α<1.

In the case of $\alpha<1$, as shown in FIG. 9, when the discharge current control is effected under such a condition that the DC voltage is applied as shown in FIG. 9, it is possible to adjust a peak-to-peak voltage under the DC voltage condition.

However, in the case where the charge DC voltage is adjusted stepwisely in a short time to adjust a developing contrast, the discharge current amount ΔIs is not a predetermined value, so that it is necessary to effect readjustment of a peak-to-peak voltage providing an optimum condition after density adjustment.

Further, as shown in FIG. 9, a Vd potential does not converge to a value of DC1 of the applied DC voltage, so that the surface potential is decreased by ΔVd, thus being placed in a state in which it is smaller than the target charge potential. The surface potential Vd is, e.g., a potential at a non-image portion in the case of image area exposure (IAE). A small value thereof leads to background fog.

In the present invention, in order to always obtain a desired discharge current amount, the control is effected in the following manner.

When the desired discharge current amount is taken as ΔIs, a method of determining a peak-to-peak voltage providing the discharge current amount ΔIs will be described.

In this embodiment, during the pre-print rotation operation shown in FIG. 3, the operation/determination program for the appropriate peak-to-peak voltage value of the AC voltage applied to the charging roller 2 in the charging step during the printing step in the control circuit 13 shown in FIG. 4 is executed.

Figure 10:
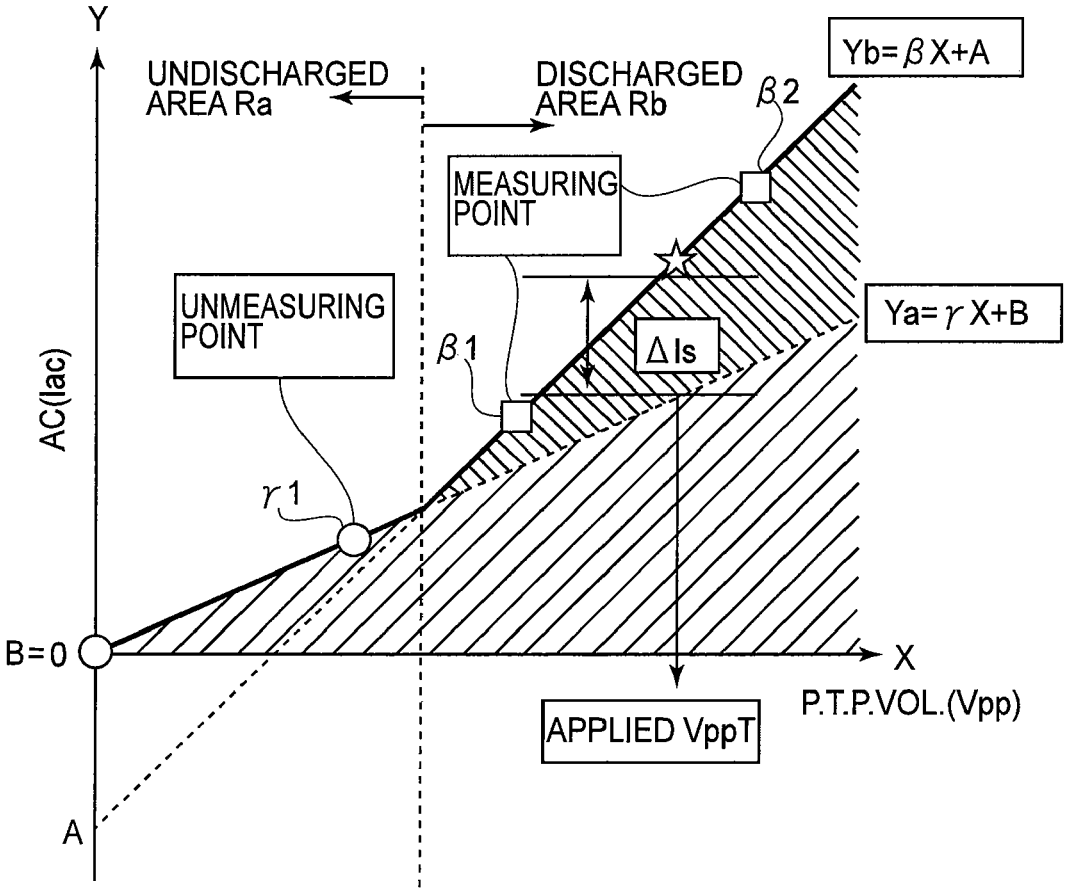
FIG. 10 is a graph for illustrating discharge current control (DC=0) in Embodiment 1.
Figure 12:
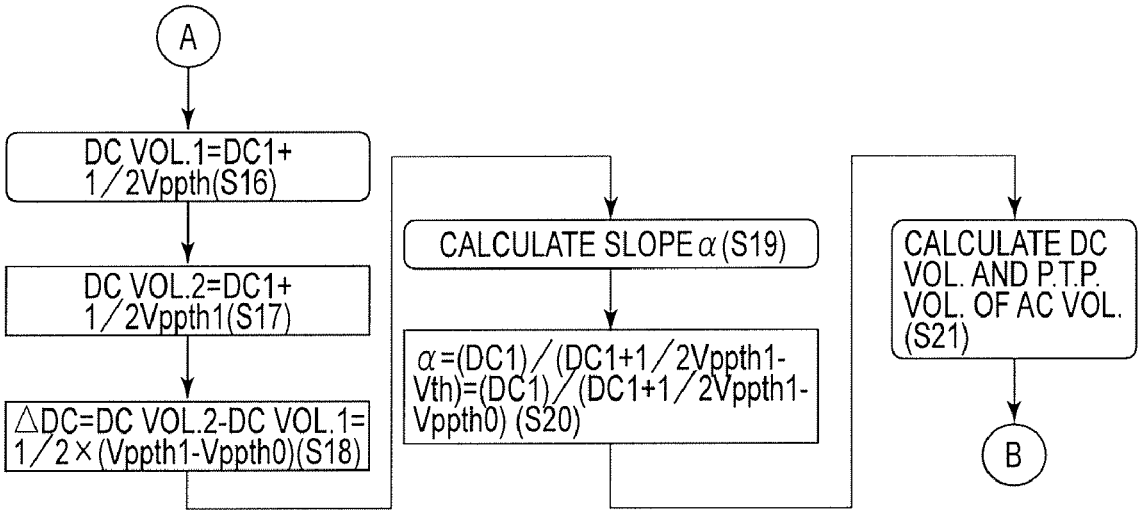
Figure 13:
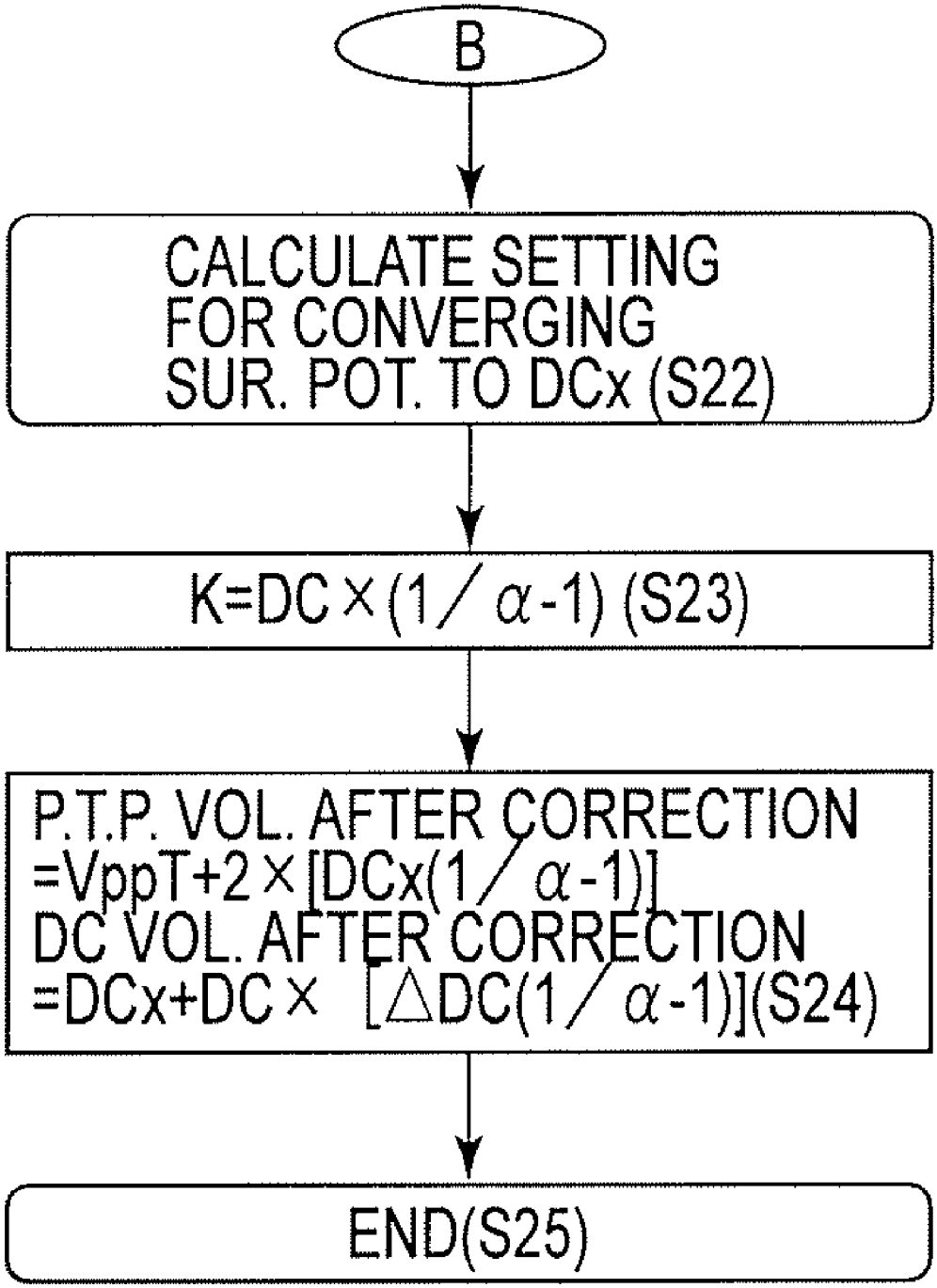

This will be described more specifically with reference to the Vpp-Iac graph of FIG. 10 and control flowcharts of FIGS. 11-13.

Figure 11:
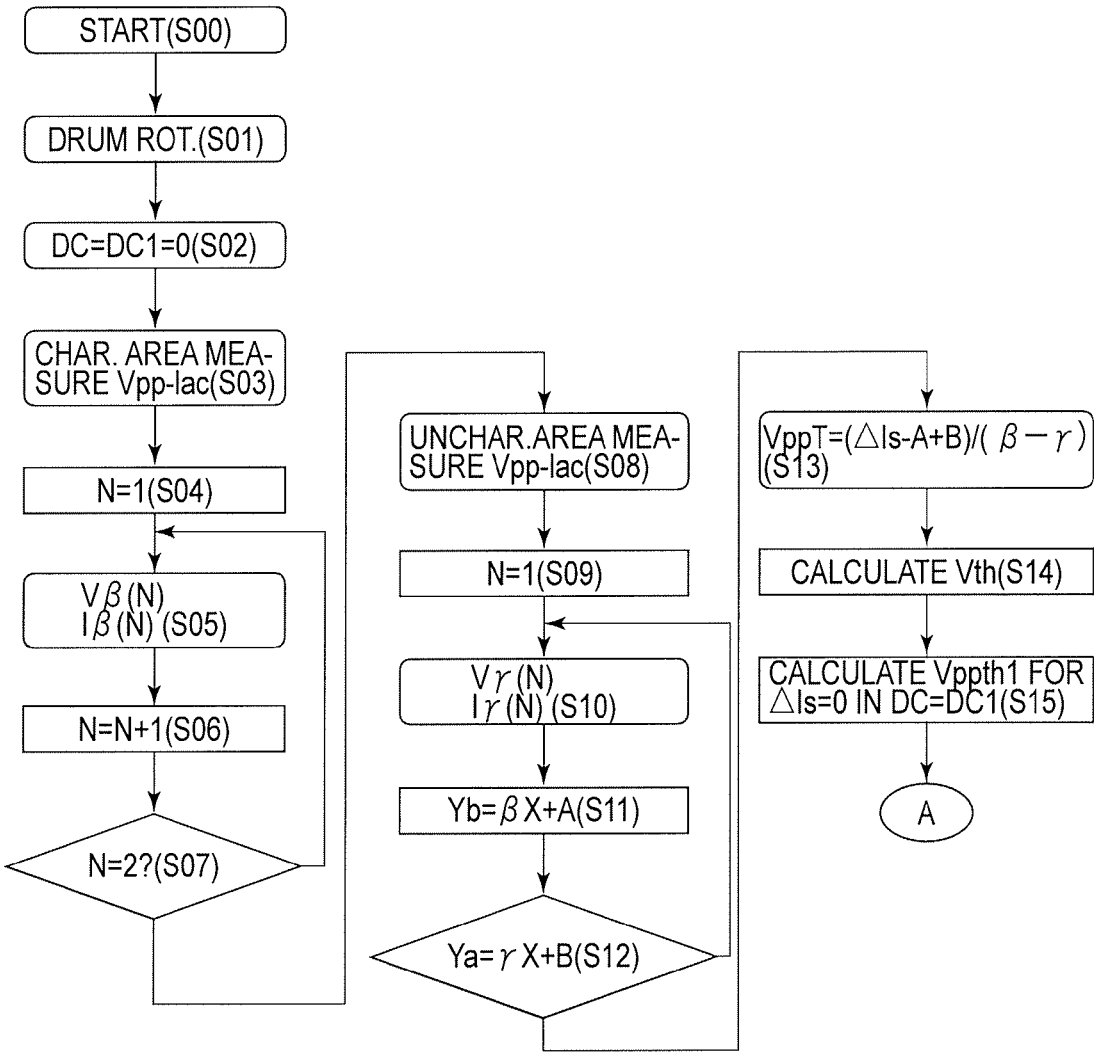
FIGS. 11 to 13 are flowcharts 1 to 3, respectively, each for illustrating a sequence of charge control in Embodiment 1.

Referring to a flowchart 1 shown in FIG. 11, when a charging condition determination control starts (S00), a drum rotates (S01). The control circuit 13 controls the AC power source 12 to successively apply two peak-to-peak voltages (point β1 and β2 in FIG. 10) in the discharged area Rb as shown in FIG. 10 (S03 to S07). Further, the control circuit 13 controls the AC power source 12 to apply one peak-to-peak voltage (point γ1 in FIG. 10) in the undischarged area Ra as shown in FIG. 10 (S08 to S10). The resultant AC current values flowing into the charging roller 2 via the photosensitive drum 1 during the application of these peak-to-peak voltages are measured by the AC current value measurement circuit 14 and inputted into the control circuit 13.

Next, the control circuit 13 performs collinear approximation of a relationship between the peak-to-peak voltage and the AC current in the discharged area Rb and the undischarged area Ra, respectively, on the basis of the three measured values to obtain formulas (2) and (3) shown below. These collinear approximation lines includes a collinear approximation line connecting the origin to the point γ1 in the undischarged area Ra and a collinear approximation line connecting the points β1 and β2.

When the collinear approximation line in the discharged area Rb is taken as Yb and that in the undischarged area Ra is taken as Ya, the following formulas (2) and (3) are derived.

$$Yb=\beta X+A \quad \text{(2) (S11), and}$$

$$Ya=\gamma X+B \quad \text{(3) (S12).}$$

Then, a peak-to-peak voltage VppT, at which a difference between the collinear approximation lines (formulas (2) and (3)) in the discharged area Rb provides a discharge current amount ΔIs, is determined according to a formula (4) shown below, whereas, in the undischarged area Ra, ΔIs=0, regardless of the value of Vpp. Here, the desired discharge current amount is ΔIs and in this embodiment, Iac is adjusted to 0 (μA), i.e., B=0 under a condition of charge DC voltage=0 V and Vpp=0 V.

$$VppT=(\Delta Is-A+B)/(\beta-\gamma) \quad \text{(4) (S13)}$$

Next, a calculation method of the DC discharge start voltage Vth (S14) will be described.

As shown in FIGS. 6 and 9, in the case where the peak-to-peak voltage Vpp is changed under the condition of charge DC voltage=0 V and the AC discharge start voltage Vppth0 is measured, when the discharge start voltage is taken as Vth, Vth is (½)Vppth0. At this time, the surface potential Vd0 is zero volts.

Further, at the charge DC voltage of DC1 (>0), the AC discharge start voltage Vppth1 providing ΔIs=0 is calculated (S15). Then, from Vppth0 calculated under the condition of DC=0 V, DC voltage 1 is calculated according to the following formula:

$$\text{DC voltage 1}=\text{DC1}+(1/2)Vppth0 \quad \text{(S16).}$$

Further, from Vppth1 calculated under the condition of DC=DC1, DC voltage 2 is calculated according to the following formula:

$$\text{DC voltage 2}=\text{DC1}+(1/2)Vppth1 \quad \text{(S17).}$$

In the present invention, α1 is measured by applying the charge DC voltage of zero volts and the charge DC voltage of DC1 (−200 V in this embodiment), respectively.

In the case, as is understood from FIG. 9, a DC voltage difference caused by the slope of DC discharge characteristic is calculated as (½)ΔVppth according to the following formula:

$$\begin{aligned}\Delta\text{DC} &= \text{DC voltage 2} - \text{DC voltage 1} \quad \text{(S18)}\\ &= (\text{DC1} + (1/2)Vppth1) - (\text{DC1} + (1/2)Vppth0)\\ &= (1/2)\times(Vppth1 - Vppth0).\end{aligned}$$

In the case of applying the charge DC voltage 1, the surface potential under the application condition of the peak-to-peak voltage Vppth1 converges to Vd1=DC1.

Then, the slope α of the DC charge characteristic (relationship between DC voltage and surface potential) is calculated by a calculation means (S19).

When two points on the DC discharge characteristic are taken as P1=(Vth, 0) and P2(DC1+(½) Vppth1, DC1), the slope α is calculated according to the following formula:

$$\begin{aligned}\alpha &= (\text{DC1})/(\text{DC1} + (1/2)Vppth1 - Vth) \quad \text{(S20)}\\ &= (\text{DC1})/(\text{DC1} + (1/2)(Vppth1 - Vppth0)).\end{aligned}$$

Based on the above calculated value of the slope α, a value of DC voltage applied during image formation and a peak-to-peak voltage of AC voltage corresponding to the DC voltage value are calculated (S21).

In the following, the peak-to-peak voltage value VppT at which the discharge current amount ΔIs is obtained by performing the discharge current control at DC=0 and a method of converging the surface potential to DCx when the DC voltage is DCx (S22) will be described.

As shown in FIG. 9, by the influence of the slope α, when the surface potential Vd (=DCx) is intended to converge from DC=0 to the DC voltage DCx during image formation, a change in DC voltage value to be changed is represented by the following formula:

$$\Delta DC = DCx - DC0(=0\ V) = DCx.$$

Accordingly, the surface potential is lacking by ΔVd=DCx (1−α).

Further, a value of Vpp required under the condition of charge DC voltage of DCx is obtained by adding a value of peak-to-peak voltage corresponding to ΔVd, thus providing a target discharge current amount ΔIs.

Accordingly, when an amount of correction K is considered on the DC discharge characteristic shown in FIG. 9, the correction amount K is represented by the following formula:

$$\begin{aligned} K &= (1/2)\Delta Vpp \\ &= \Delta Vd/\alpha 1 \\ &= DCx(1/\alpha 1) \\ \Delta Vpp &= 2 \times DCx(1/\alpha 1). \end{aligned} \quad \text{(S23)}$$

When the peak-to-peak voltage after the correction is taken as VppT', it is represented by the following formula:

$$VppT' = VppT + 2 \times [DCx(1/\alpha 1)] \quad \text{(S24).}$$

As described above, the peak-to-peak voltage after the correction is obtained by the charging condition determination means.

Further, α1 is not equal to 1, so that under the condition of charge DC voltage=DCx, the surface potential Vd is also not equal to DCx. For this reason, it is necessary to adjust the charge DC voltage so that the surface potential Vd is equal to DCx under the condition of α1.

A DC voltage DCx', after the correction, for providing the surface potential Vd=DCx is represented by the following formula:

$$DCx' = DCx + DCx(1/\alpha 1) \quad \text{(S24).}$$

Then, the peak-to-peak voltage applied to the charging roller 2 is switched to VppT' obtained by the above-described method and the DC voltage is switched to DCx', thus effecting the constant voltage control, so that the operation goes to the above-described printing step.

In this embodiment, VppT' and DCx' are obtained on the basis of DC=0 but may also be calculated under the condition of DC1. More specifically, the above-described method may also be performed with respect to a difference between the charge DC voltage during discharge current control and the charge DC voltage DCx during image formation. Further, in this embodiment, the charge DC voltages during discharge current control and during image formation have different values but there is no problem even when the operation is effected at the same value of the charge DC voltages.

As described above, the printer calculates a peak-to-peak voltage, required for obtaining a desired discharge current amount during the printing, during the pre-print rotation. As a result, the printer is capable of applying the calculated peak-to-peak voltage during the printing by the constant voltage control. As a result, the printer is capable of accommodating deviations or irregularities in production of the charging roller 2, electric resistance due to environmental change in material, and high voltage applied from a main assembly of the printer, thus providing a desired discharge current amount with reliability. The above described control may also be effected at the time of preparing for an image formable state of the image forming apparatus (printer) even during a period other than during the pre-rotation of image formation.

When a study on continuous image formation under the above-described control is made, in any environment, a degree of deterioration and wearing of the photosensitive drum 1 and an amount of filing are reduced, so that it is possible to prolong the life of the photosensitive drum 1 compared with the conventional discharge current control.

Further, in this embodiment, the desired discharge current amount ΔIs and the peak-to-peak voltage applied during the pre-print rotation are constant in the respective environments. However, in an apparatus provided with an environmental sensor (thermometer and hygrometer) 15, it is possible to effect further uniform charging by variably changing the respective values for each environment.

As described above, the AC voltage values are measured by successively applying one peak-to-peak voltage in the undischarged area Ra and at least two peak-to-peak voltage in the discharged area Rb during the pre-print rotation, whereby the peak-to-peak voltage applied during the printing is determined. As a result, by using the peak-to-peak voltage and DC voltage value always providing a desired discharge current amount, the deterioration and wearing of the photosensitive drum 1 and charge stability can be realized compatibly, so that it is possible to realize the long life of the photosensitive drum 1 and high image quality.

Further, it is also possible to accommodate the irregularity in electric resistance of the charging roller 2 during the production, so that a tolerable range of material and accuracy is increased. As a result, production costs can be reduced, thus being capable of providing an inexpensive product to users.

Further, by effecting the determination of the charging condition by the charging condition determination control during a startup operation after turning the power source of the image forming apparatus on or at every interval of predetermined number of sheets or predetermined time, stability can be improved.

As described above, according to this embodiment of the present invention, it is possible to decrease the difference between the voltage during image formation under the voltage condition set by the adjustment and the target surface potential even when the charge characteristic is changed depending on the state of the image forming apparatus.

Embodiment 2

In this embodiment, the general constitutions of the image forming apparatus and the charge control apparatus are the same as those in Embodiment 1, thus being omitted from explanation.

In Embodiment 1, the correction method of the discharge current control always performed under the condition of Iac=0 when the peak-to-peak voltage is zero volts under the condition of DC=0 V is described.

In this embodiment, the case where the cleaning apparatus 6 disposed opposite to the photosensitive drum 1 in the image forming apparatus shown in FIG. 1 is not used, i.e., the case where the present invention is applied to a cleaner-less type image forming apparatus will be described. In such a cleaner-less system, charging is effected by applying a negative-polarity bias (voltage) to the charging member thereby to electrically charge the photosensitive drum 1 to negative polarity. Then, an electrostatic latent image formed on the photosensitive drum 1 by exposure means is developed with toner as a toner image, which is then transferred onto a recording material P. Toner (transfer residual toner) remaining on the surface of the photosensitive drum 1 after the transfer is electrically charged negatively by applying a negative-polarity bias by means of an auxiliary charging brush. The negatively charged toner is not readily deposited on the charging member to which the negative-polarity bias is applied, so that the toner passing through the charging member is recovered by a developing device.

In such a constitution, the toner (transfer residual toner) remaining on the surface of the photosensitive drum 1 without being transferred onto the recording material P during the toner image transfer is again moved in an area of the charging roller 2, so that the toner which has not been sufficiently charged negatively is liable to deposit on the charging roller 2. Further, an amount of deposition of an external additive is also increased in the constitution employing the cleaning member.

In such a state, the slope of DC discharge characteristic is largely changed by a change in amount of the transfer residual toner varying depending an image to be outputted.

Further, when the external additive is deposited on the charging roller 2, in the H/H environment, the DC discharge characteristic is also changed by moisture absorption. As a result, a surface resistance is lowered, thus resulting in a change in DC discharge characteristic.

Further, the potentials after the transfer are not equal to each other due to optical charge removal or the like, so that it is difficult to directly determine the DC discharge start voltage even when the discharge start voltage is calculated by performing the discharge current control at DC=0 V similarly as in Embodiment 1.

In this embodiment, the DC voltage in the case of effecting the discharge current control is applied under different two conditions (DC1 and DC2), so that the values of the DC discharge start voltage at the slope α are calculated to determine the charge DC voltage and peak-to-peak voltage during image formation with accuracy. Hereinbelow, such a determination method will be described.

Figure 15:
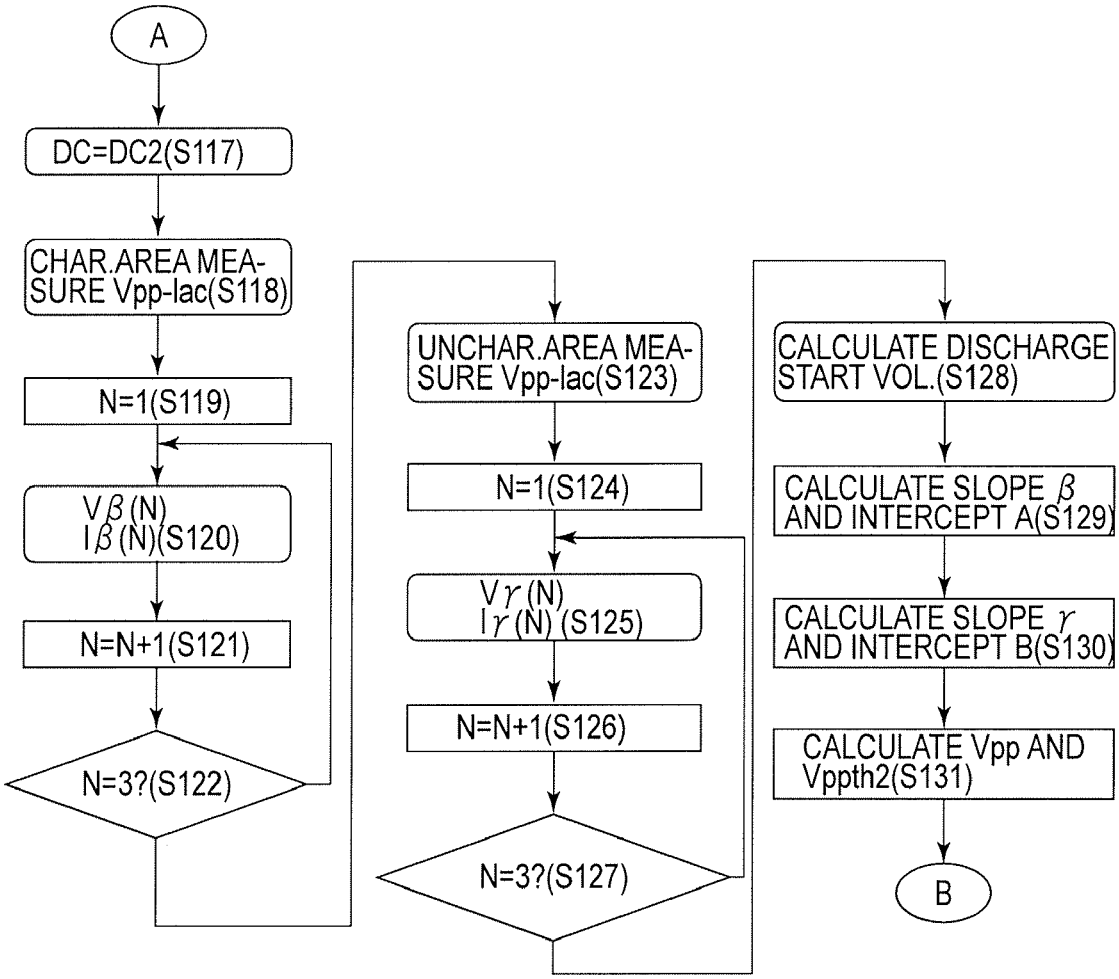
Figure 16:
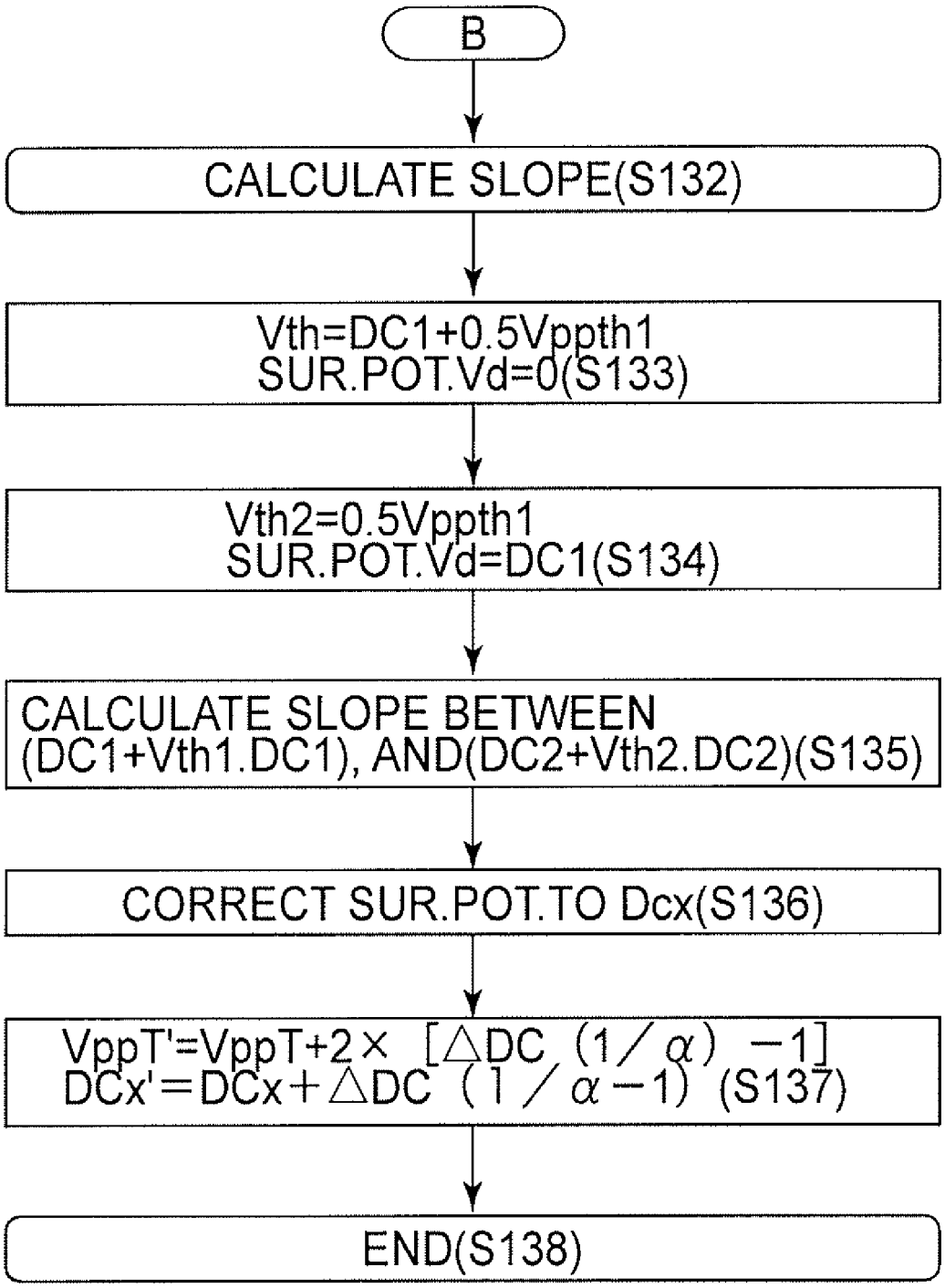
Figure 17:
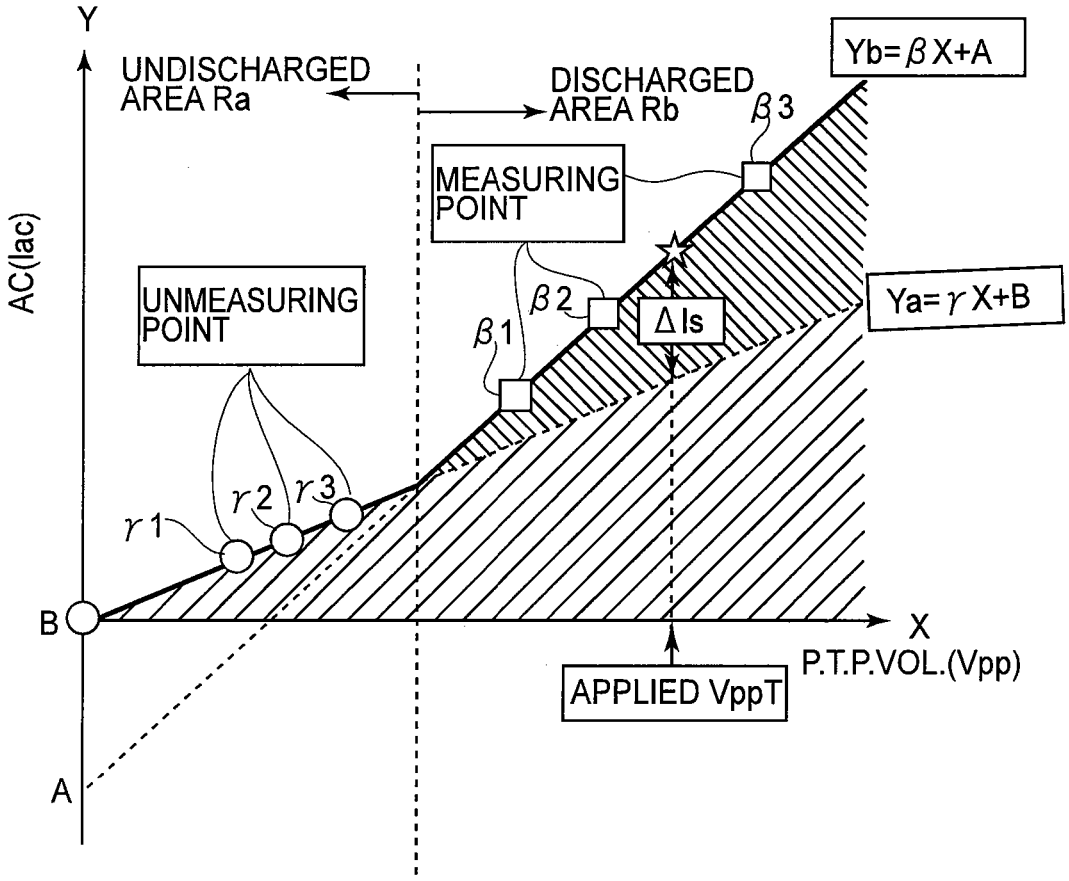
FIG. 17 is a graph for illustrating discharge current control in Embodiment 2.

FIG. 17 is a schematic view showing the case where an AC current Iac is measured by changing the peak-to-peak voltage Vpp at three levels in the undischarged area Ra and the discharged area Rb with reference to the case of the charge DC voltage=0 V in Embodiment 1 described above. Further, flowcharts of the discharge current control in this embodiment are shown in FIGS. 14 to 16.

Figure 14:
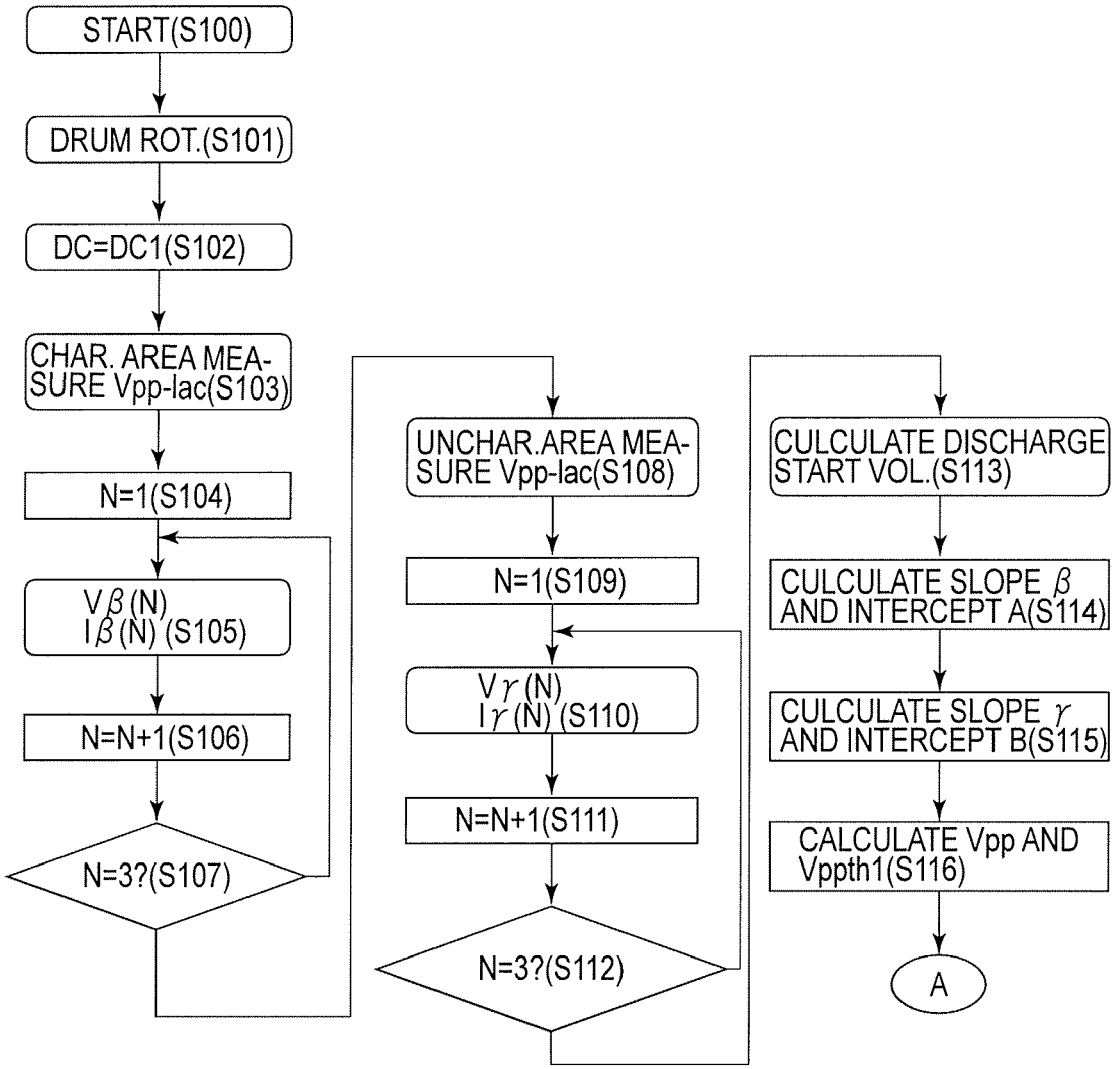
FIGS. 14 to 16 are flowcharts 1 to 9, respectively, each for illustrating a sequence of charge control in Embodiment 2.

Referring to the flowchart in FIG. 14, when the control is started (S100), a drum is rotated (S101) and a predetermined DC voltage is applied to the drum. A value of the DC voltage may be zero volts or other values.

Then, as shown in FIG. 17, three peak-to-peak voltages Vpp (Vβ1, Vβ2, and Vβ3) are applied at three points (β1, β2, and β3), respectively, in the discharged area Rb, thus obtaining three values of AC currents Iac (Iβ1, Iβ2, and Iβ3), respectively (S103 to S107). Similarly, in the undischarged area Ra, three peak-to-peak voltages Vpp (Vγ1, Vγ2, and Vγ3) are applied at three points (γ1, γ2, and γ3), respectively, thus obtaining three values of AC currents Iac (Iγ1, Iγ2, and Iγ3), respectively (S108 to S112).

In this embodiment, the control circuit 13 employs the method of least square with respect to the measured three current values in the above-described discharged area Rb and the measured three values in the above-described undischarged area Ra. Further, the control circuit 13 effects collinear approximation of a relationship between the peak-to-peak voltage Vpp and the AC current Iac in the discharged area Rb and the undischarged area Ra to obtain formulas (2) and (3) shown below similar to those in Embodiment 1, respectively. A collinear approximation line in the discharged area Rb is taken as Yb, and that in the undischarged are Ra is taken as Ya.

$$Yb=\beta X+A \quad (2)\ (S114)$$

$$Ya=\gamma X+B \quad (3)\ (S115)$$

From these collinear approximation lines, in the same manner as in Embodiment 1, a peak-to-peak voltage VppT for obtaining a desired discharge current amount ΔIs is represented by the following formula (4):

$$VppT=(\Delta Is-A+B)/(\beta-\gamma) \quad (4)$$

Thereafter, in the same manner as in Embodiment 1, a DC discharge start voltage Vth and a slope α1 of a DC discharge characteristic (relationship between DC voltage and surface potential) are calculated.

Next, a DC voltage having a value of DC1 is applied to the charging roller 2. From a peak-to-peak voltage-current function F1 (Vpp) obtained by measuring current values when an AC voltage including at least two peak-to-peak voltages having a value less than two times the value Vth is applied and a peak-to-peak voltage-current function F2 (Vpp) obtained by measuring current values when an AC voltage including at least two peak-to-peak voltages having a value two times or more the value Vth, an AC voltage discharge start peak-to-peak voltage providing target discharge current amounts ΔIs=0 and ΔIs=F2(Vpp)−F1(Vpp) is taken as Vppth1 (S116).

In this case, the DC voltage 1 is represented by the following formula:

$$\text{DC voltage 1}=\text{DC1}+(1/2)Vpp\text{th}1.$$

Further, the surface potential Vd1 is DC1.

Next, a DC voltage having a value of DC2 is applied to the charging roller 2. From a peak-to-peak voltage-current function F1 (Vpp) obtained by measuring current values when an AC voltage including at least two peak-to-peak voltages having a value less than two times the value Vth is applied and a peak-to-peak voltage-current function F2 (Vpp) obtained by measuring current values when an AC voltage including at least two peak-to-peak voltages having a value two times or more the value Vth, an AC voltage discharge start peak-to-peak voltage providing target discharge current amounts ΔIs=0 and ΔIs=F2(Vpp)−F1(Vpp) is taken as Vppth2 (S131).

In this case, the DC voltage 2 is represented by the following formula:

$$\text{DC voltage 2}=\text{DC2}+(1/2)Vpp\text{th}2.$$

Further, the surface potential Vd1 is DC2.

From relationships at two points (P1 and P2) between DC voltage and surface potential obtained under the above-described different three conditions, a slope α of the DC voltage—surface potential characteristic, i.e., the DC discharge characteristic is calculated (S132).

$$P1=(\text{DC1}+(1/2)Vpp\text{th}1,\ \text{DC1}) \quad (S133)$$

$$P2=(\text{DC2}+(1/2)Vpp\text{th}2,\ \text{DC2}) \quad (S134)$$

Accordingly, the slope α is calculated according to the following formula:

$$\alpha 1=(\text{DC2}-\text{DC2})/[(\text{DC2}-\text{DC1})-(1/2)(Vpp\text{th}2-Vpp\text{th}1)].$$

In the following, the peak-to-peak voltage VppT at which the discharge current amount ΔIs is obtained by performing the discharge current control at the DC voltage of DC1 and a method of converging the surface potential to DCx when the DC voltage is DCx (S136) will be described.

The DC discharge start voltage is calculated from the measurement result of current measured under the condition of the DC voltage DC1 while taking the value Vth providing the surface potential Vd=DC1 as (½)Vpth1, so that the peak-to-peak voltage VppT of AC voltage providing ΔIs=F2(Vpp)−F1(Vpp) is determined.

When the above-described slope α of the discharge characteristic is used as a correction coefficient and a voltage different (ΔDC) between the charge DC voltage of DCx during image formation and a value of the charge DC voltage applied during discharge current control is represented by the formula: ΔDC=(DCx−DC1) (or ΔDC=DCx−DC2), a peak-to-peak voltage VppT' of AC voltage applied to the charging roller 2 during image formation is determined according to the following formula:

$$VppT'=VppT+2\times[\Delta DC(1/\alpha 1)-1]$$

$$DCx'=DCx+\Delta DC(1/\alpha 1) \qquad (S137)$$

Then, the peak-to-peak voltage applied to the charging roller 2 is switched to VppT' obtained by the above-described method and the DC voltage is switched to DCx', thus effecting the constant voltage control, so that the operation goes to the above-described printing step (S137).

As described above, a similar effect of the present invention is achieved also with respect to the cleaner-less type image forming apparatus.

According to the present invention, even when the charging characteristic is changed depending on a state or condition of the image forming apparatus, it is possible to decrease a difference between the target potential and the voltage during image formation under the voltage condition set by adjustment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 349846/2005 filed Dec. 2, 2005, which is hereby incorporated by reference.

What is claimed is:

1. An image forming apparatus comprising:

a photosensitive member;

a rotatable charging member configured to electrically charge said photosensitive member;

a charging bias applying device configured to apply a superimposed charging bias, comprising a DC voltage and an AC voltage which causes an electrical discharge in a gap between said photosensitive member and said rotatable charging member, to said charging member during an image formation;

a toner image forming device configured to form a toner image on said photosensitive member charged by said rotatable charging member;

an executing device configured to execute a test mode in which a superimposed test bias, comprising a DC voltage which is not zero and an AC voltage which causes the electrical discharge in the gap, is applied to said rotatable charging member by said charging bias applying device;

a detector configured to detect an electrical discharge current from said rotatable charging member to said photosensitive member when the superimposed test bias is applied to said rotatable charging member in the test mode; and a correcting device configured to correct a peak-to-peak voltage of the AC voltage of the superimposed charging bias based on a detection result of said detector, wherein said charging bias applying device applies a plurality of the superimposed test biases of which DC voltages are different from each other in the test mode, said detector detects the electrical discharge current when the superimposed test biases are applied to said rotatable charging member in the test mode, and said correcting device corrects the peak-to-peak voltage of the AC voltage of the superimposed charging bias based on the detection result of said detector.

2. An apparatus according to claim 1, wherein one of the DC voltages of the superimposed test biases is zero.

* * * * *